US006321469B1

(12) United States Patent
Cretinon

(10) Patent No.: US 6,321,469 B1
(45) Date of Patent: Nov. 27, 2001

(54) SHOE WITH DEFORMABLE SOLE STRUCTURE

(75) Inventor: Frédéric Cretinon, Metz-Tessy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/445,476

(22) PCT Filed: Apr. 16, 1999

(86) PCT No.: PCT/FR99/00895

§ 371 Date: Dec. 8, 1999

§ 102(e) Date: Dec. 8, 1999

(87) PCT Pub. No.: WO99/53787

PCT Pub. Date: Oct. 28, 1999

(30) Foreign Application Priority Data

Apr. 21, 1998 (FR) ..... 98 05216

(51) Int. Cl.[7] ..... A43B 1/10
(52) U.S. Cl. ..... 36/102; 36/107; 36/30 R
(58) Field of Search ..... 36/102, 103, 107, 36/43, 44, 30 R, 25 R, 31, 33

(56) References Cited

U.S. PATENT DOCUMENTS

| | | | | |
|---|---|---|---|---|
| 1,340,341 | * | 5/1920 | Hitchcock | 36/30 R |
| 2,211,057 | * | 8/1940 | Duckoff | 36/103 |
| 2,314,237 | * | 3/1943 | Muller | 36/30 R |
| 2,370,301 | * | 2/1945 | Ghez et al. | 36/33 |
| 2,370,302 | * | 2/1945 | Ghez et al. | 36/33 |
| 3,662,478 | * | 5/1972 | Schwab | 36/59 R |
| 4,597,199 | | 7/1986 | Hong | 36/114 |
| 5,025,573 | | 6/1991 | Giese et al. | 36/30 R |
| 5,720,118 | | 2/1998 | Mayer et al. | 36/107 |

FOREIGN PATENT DOCUMENTS

| | | |
|---|---|---|
| 246465 | 10/1947 | (CH) . |
| 8815448 | 3/1989 | (DE) . |
| 0190714 | 8/1986 | (EP) . |
| 0373330 | 6/1990 | (EP) . |
| 1221716 | 6/1960 | (FR) . |

* cited by examiner

*Primary Examiner*—Paul T. Sewell
*Assistant Examiner*—J. Mohandesi
(74) *Attorney, Agent, or Firm*—Greenblum & Bernstein, P.L.C.

(57) ABSTRACT

A boot that includes a sole made of at least two layered portions, i.e., a wear layer and a reinforcement, or nerve layer. The nerve layer is equipped with a flexible structure located inside a frame, the structure being formed by at least one transverse recess that defines, between its two ends, the contour of at least one strip centered in the nerve layer longitudinal direction. The sole of the invention offers reinforced longitudinal flexibility through the strip, while being capable of being transversely deformed in its central zone by attenuating ground surface roughness.

27 Claims, 4 Drawing Sheets

SHOE WITH DEFORMABLE SOLE STRUCTURE

BACKGROUND OF THE INVENTION

1. Field of the Invention

The invention is related to a boot comprising a sole made of at least two layered portions, i.e., a wear layer and an insert, or nerve layer, and is related to a structure of the nerve layer which is capable of providing a differentiated flexibility between the periphery of the sole and its central zone so as to encourage bending while walking, and also ensuring a good edge setting.

2. Description of Background and Relevant Information

Boots of the aforementioned type are known, in particular in Swiss Patent No. 246,465, French Patent No. 1,221,716, and U.S. Pat. No. 5,025,573.

These patents disclose soles which comprise an intermediate nerve layer provided, on the one hand, with transverse volume reductions adapted to facilitate bending of the soles while walking and, on the other hand, a relatively rigid frame delineating its periphery and allowing for edge settings or, in other words, lateral gripping.

More specifically, in the example of Swiss Patent No. 246,465 and French Patent No. 1,221,716, the nerve layer is made longitudinally flexible due to recesses that define, inside its frame, rectilinear transverse spacers, parallel with respect to one another and/or, partially in an "X", especially in the zone corresponding to the instep, i.e., near the metatarsophalangian joint of the user's foot. As is apparent, these spacers are not provided to have the ability to bend inside the frame of the nerve layer.

Indeed, French Patent No. 1,221,716 teaches that the object of the "X" shaped arrangement of the spacers is to provide a portion with a very substantial rigidity, and that the parallel arrangement of the other spacers is adapted to allow flexibility of the nerve layer, and thus of the sole, essentially when the foot is in the course of motion, i.e., about a transverse axis.

In such a construction, the nerve layer allows a very firm edge setting over sloping terrain, but has the drawback of limiting the contact surface in the sole-ground interface only along the outer edge of the sole and to a very limited extent. As a matter of fact, the transverse rigidity provided to the nerve layer by its spacers prevents the sole from being deformed in its central zone so that it can adapt to the rough spots on the ground, and it especially prevents it from curving downwardly to a significant degree in order to increase the contact surface in the sole/ground interface, and thus provide a sure and stable support that is required for propulsion.

In the example where the nerve layer of the sole comprises rectilinear transverse spacers such as described in Swiss Patent No. 246,465, such spacers are also not provided to be flexible, quite the contrary. Indeed, in each spacer, the intermediate portion located between the two ends that are affixed to the frame of the nerve layer is provided with strips of material that are folded over towards the side directed towards the wear surface of the sole, so as to increase the wear resistance of the latter.

The result of constructing spacers such as these is that when they are seen in a section, they have an open profile shaped like an inverted U, which makes them, as well as the central zone of the sole over which they extend, almost non-deformable.

At any rate, even in the absence of these folded material strips, it appears that this intermediate zone of each spacer is not capable of bending significantly with respect to the frame of the nerve layer, in a transverse direction with respect to the sole. Indeed, in the embodiment mentioned, which especially corresponds to the boot described in European Patent No. 190,714, the intermediate zone of the spacers can only bend, or more specifically curve, if it has extension characteristics, and this, in combination with the flexibility of the frame, which must again be able to become tightened so as to allow the two ends of each spacer to come together as a result of the curvature produced on the latter. However, a sole functions this way in a very random manner because its various component layers are necessarily assembled to one another and to the boot upper, especially along their peripheries, i.e., along the flame of the nerve layer, which makes it very rigid in a transverse direction. Whatever the case may be, the potential tightening of the frame of the nerve layer would also cause a tightening of the boot upper on the user's foot in the transverse direction, and this would have a substantially adverse impact on its comfort.

As has been represented schematically in the annexed FIGS. 1, 2 and 3, these known soles of the prior art, where the nerve layer 3 has rectilinear spacers 4 that are parallel to one another and oriented transversely, have proven to be ill-adapted to provide a support 5 that is sure and stable in an edge setting, especially over a sloping terrain 26, nor do they provide a good grip. As a matter of fact, the nerve layer 3 lacks the capacity to become transversely deformed inside its frame 2, thus preventing the sole, and thereby the wear layer 8 from curving downwardly in the central zone 1 under the effect of the forces that are exerted laterally along that portion of its periphery that is in contact with the ground.

Furthermore, and contrary to their lack of transverse deformation capacity, these soles are characterized by a great ability for longitudinal deformation in the direction of the course of motion of the foot due to the fact that the recesses 6 determining the spacers 4 only allow small material bridges 6' to remain at the ends thereof. Indeed, these small material bridges 6', that partially form the frame 2 of the nerve layer 3, practically constitute the only resisting means of the nerve layer 3 that are capable of resisting the longitudinal bending of the latter (FIG. 2), because the spacers are too narrow 7 to be biased in that direction in view of the largeness of the radius of curvature "R" to which the sole is subjected and the zones of weakness constituted by the material bridges 6'.

This great facility for deformation, which is advantageously preferred for certain types of boots, such as leisure, relaxation, running or walking boots, is, conversely, a hampering factor for boots adapted for hiking over hilly terrains and, generally speaking, for so-called mountaineering boots. Indeed, these boots which are used in very technical maneuvers must provide a firm and precise frontal grip that has to remain almost invariable during the course of motion of the foot, especially during the propulsion phase. In addition, these boots are adapted, even if occasionally, to be equipped with ice cleats for advancing over icy terrain and, as a result, must have a sole that is adequately rigid in the longitudinal direction so that it can be used for such a purpose.

Soles such as those described in Swiss Patent No. 246,465 and European Patent No. 190,714 have thus proven to be ill-adapted for so-called mountaineering boots because they have too much longitudinal flexibility.

This drawback also appears in the case of soles whose nerve layer is provided with a central recess in the zone corresponding to the user's instep, for example, in an embodiment disclosed by U.S. Pat. No. 5,025,573. Indeed, in this embodiment, the central recess obtained in the nerve layer leaves behind only two relatively narrow strips of material that extend into the periphery zone of the sole and in the longitudinal direction thereof. As a result, there is very little resistance to the longitudinal bending of the sole.

However, as compared to the soles described previously, this sole with a central recess in the instep zone has proven to be relatively well-adapted to provide, in the edge setting phase, a relatively sure and stable support, as well as a good grip, because it is characterized by a substantial capacity for transverse deformation in its central zone, inside the frame of the nerve layer.

However, in the absence of transverse spacers, the rough spots on the ground are neither filtered nor dampened between the wear surface of the sole and the user's foot. These soles whose nerve layer is devoid of transverse spacers have thus proven to be ill-adapted to be used in their present form in boots adapted for walking over varied and rough terrains.

To summarize, the previously known soles described hereinabove, whose nerve layer provides a differentiated flexibility between their peripheries and their central zones, continue to provide too much capacity for longitudinal deformation, together with, depending on their method of construction, excessive rigidity or excessive flexibility in the transverse direction.

SUMMARY OF THE INVENTION

It is an object of the instant invention to overcome the aforementioned drawbacks by proposing a sole providing a differentiated flexibility between its periphery and its central zone, and capable of offering an optimum compromise between, on the one hand, longitudinal flexibility while walking and, on the other hand, the capacity for transverse deformation in the central zone, so as to make walking easier while also attenuating ground surface roughness.

The invention also has an object of providing a sure and stable support that is necessary for propulsion during the course of motion of the foot by significantly increasing the contact surface in the sole/ground interface, in particular during edge setting over sloping terrain.

In order to achieve these goals, the sole is made of at least two layered portions, i.e., a wear layer and a nerve layer, the latter having a frame that delineates its periphery, and at least one transverse recess that leaves behind, at its two ends, material bridges that partially constitute the frame.

At least one substantially transverse recess in the nerve layer defines, between its two ends, the contour of at least one strip whose attaching base originates from the nerve layer and whose free end extends inside the frame thereof while remaining substantially centered in the nerve layer longitudinal direction. According to a complementary characteristic, the strip is obtained in correspondence with that zone of the sole which is made to bend longitudinally by following a certain radius of curvature during the course of motion of the user's foot while walking. In addition, the strip is provided with a certain length that is defined in accordance with this radius of curvature that the sole is made to follow so that it can be biased to bend, between its attaching base and its free end, and this is done concomitantly with the bending of the frame of the nerve layer.

More specifically, when the boot is caused to deform by following a small radius of curvature, the strip can be provided to be relatively short. Conversely, when the boot has a sole that is caused to bend by following a large radius of curvature, the strip must be provided to be long enough for it to be biased to bend significantly.

These arrangements of the strip reinforce the resistance exerted by the frame of the nerve layer in the direction of longitudinal bendings and allows, in the area over which it extends, a certain possibility for the transverse and vertical deformation of the sole.

Indeed, due to the relative mobility of its free end within the frame of the nerve layer, it allows the central zone of the sole to be deformed without biasing the frame of the nerve layer. Due to this flexible structure of the nerve layer, the sole can adapt, in its central zone, to the roughness of the ground while preserving the comfort of the foot because the strip acts like a shield that filters the pressures and shocks by diffusing them over its entire surface. The sole can also, especially during edge setting, curve downwardly in its central zone under the effect of the forces that are exerted laterally on that portion of its periphery that is in contact with the ground, and thus significantly increase the contact surface in the sole/ground interface.

In a preferred embodiment, the nerve layer of the sole is made with a series of strips that are more or less intertwined together by their free ends. In this way, the strips constitute bands that are independent of one another and essentially kept at the level of the nerve layer frame, in the extension of the material bridges that remain at the ends of the transverse recesses.

For example, when each recess determines a strip with a broken contour, similar to a "V", a series of bands of a certain length is obtained which constitute a zigzag structure within the frame of the nerve layer. It is obvious that each strip can have a contour that is different from the one indicated hereinabove, such as, for example, a sinuous contour.

BRIEF DESCRIPTION OF THE DRAWINGS

The invention will be better understood in light of the description that follows with reference to the annexed, schematic drawings showing, by way of example, embodiments of the sole of the invention, in which:

in FIG. 7, the behavior of the nerve layer in longitudinal bending, as seen along the cross-sectional line of VII—VII of FIG. 6; in FIG. 8, the transverse deformation of the flexible structure of the nerve layer with the wear layer during an edge setting on a sloping terrain, as seen along the cross-sectional line of VIII—VIII of FIG. 6; and in FIG. 9, the vertical deformation of the flexible structure of the nerve layer with the wear layer while taking flat support on a rough terrain, as seen along the cross-sectional line of VII—VII of FIG. 6.

DETAILED DESCRIPTION OF THE INVENTION

Figure 1:
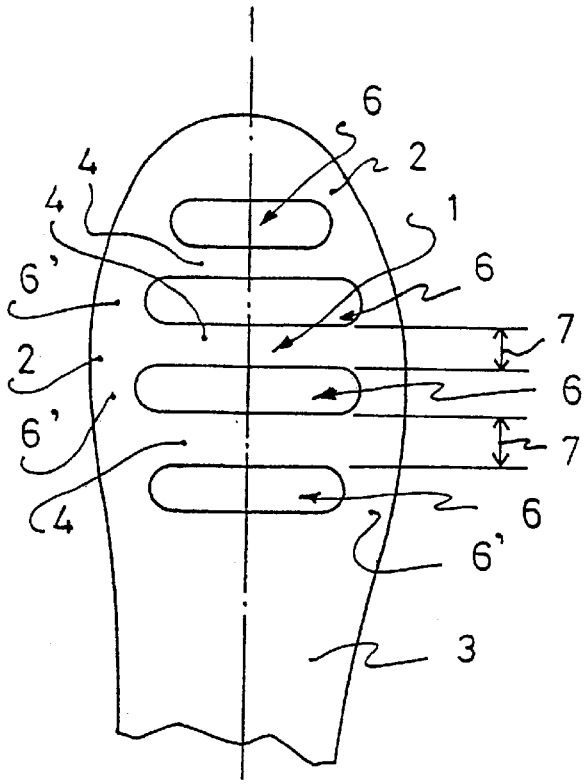
Prior Art FIG.1
FIGS. 1–3 illustrate schematic representations of the aforementioned prior art.
Figure 2:
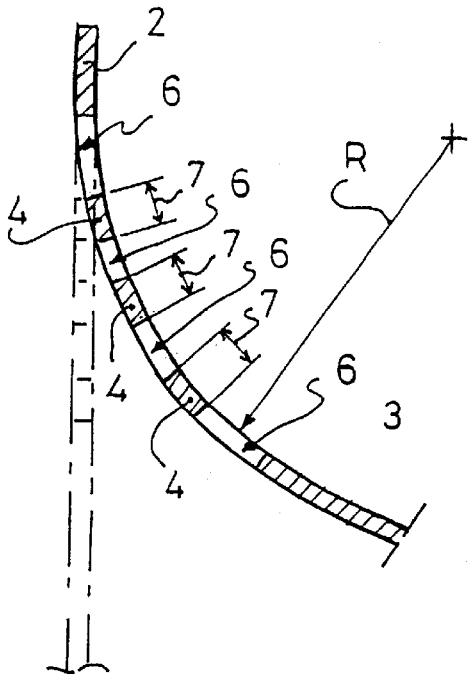
Prior Art FIG.2
Figure 3:
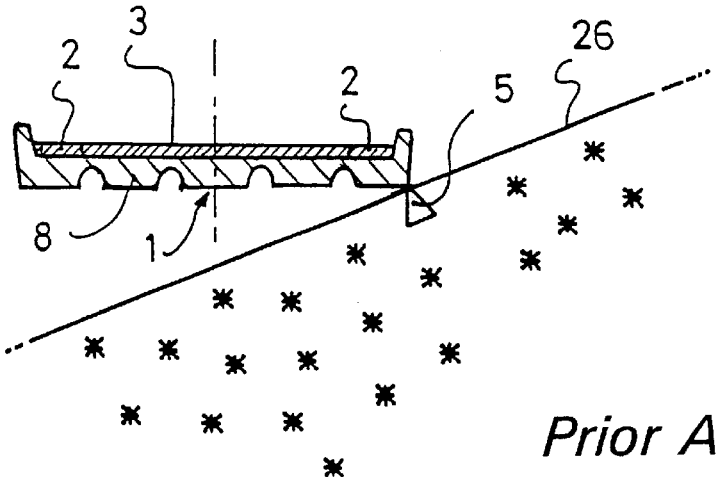
FIG.3 Prior Art
Figure 4:
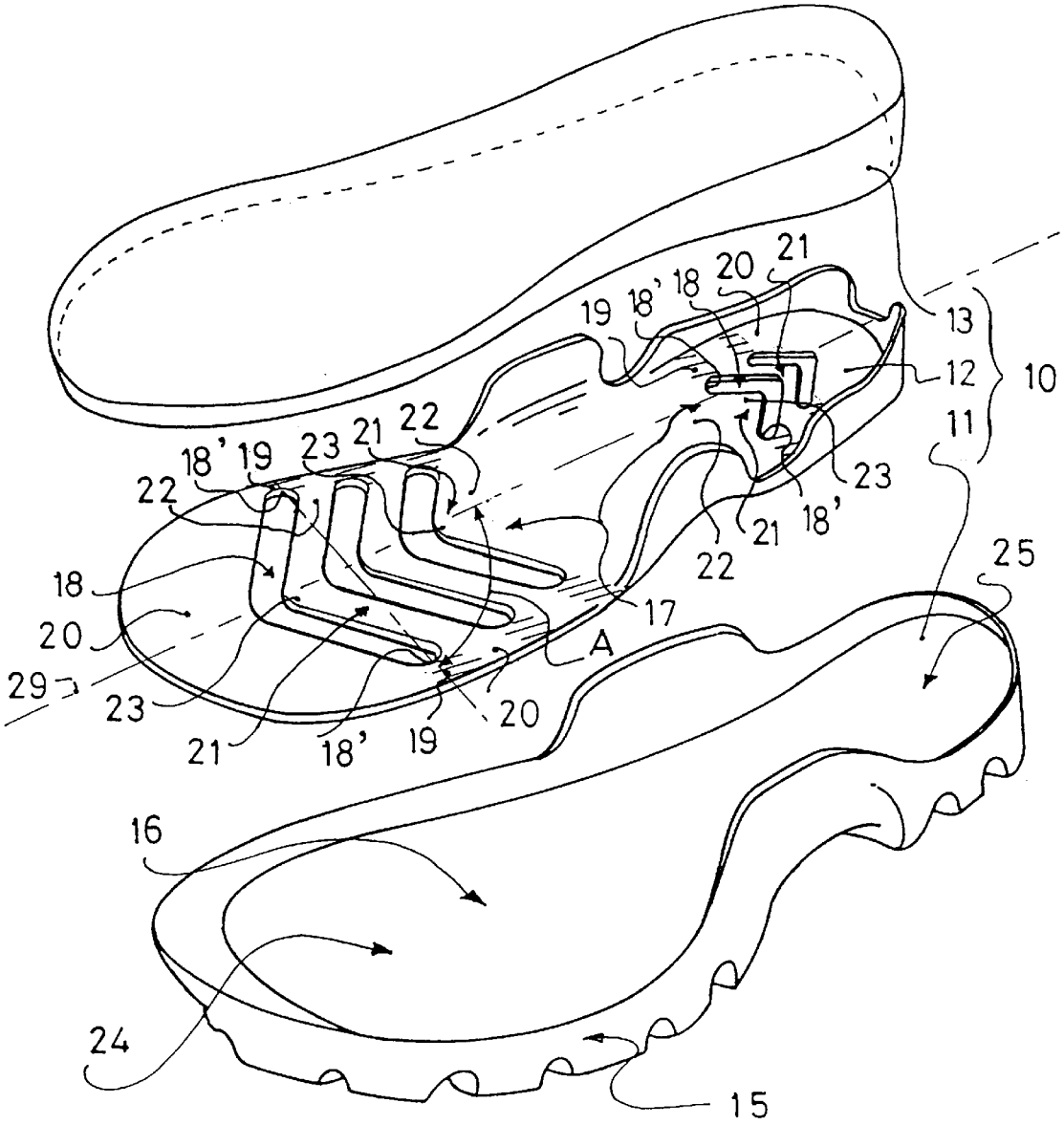
FIG. 4 illustrates, in an exploded perspective view, a sole of a boot comprising a nerve layer equipped with a flexible structure according to a first embodiment of the invention.
Figure 5:
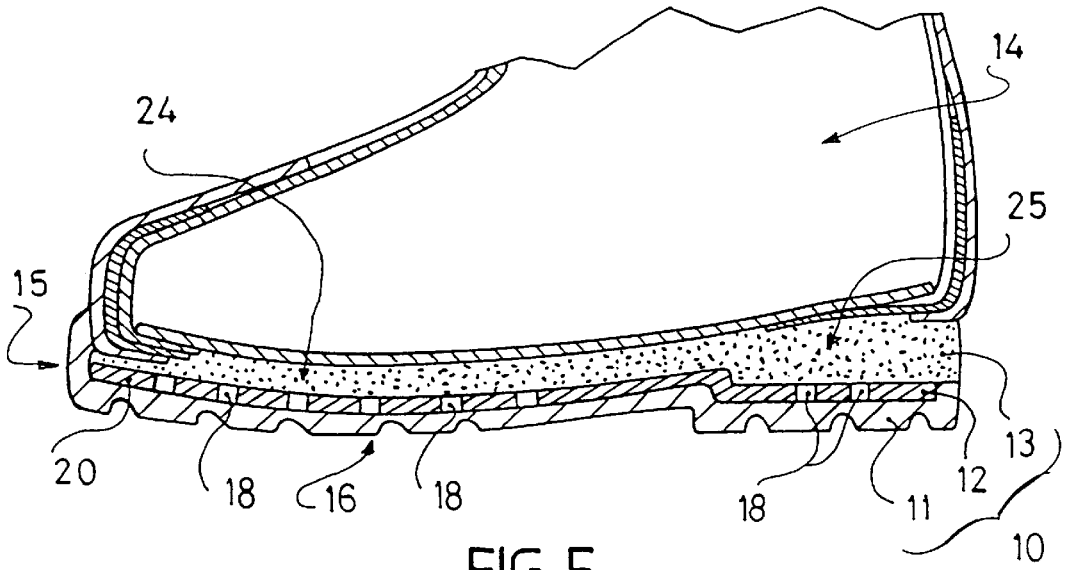
FIG. 5 illustrates, in a partial, longitudinal cross-sectional view, a boot provided with the sole of FIG. 4.
Figure 6:
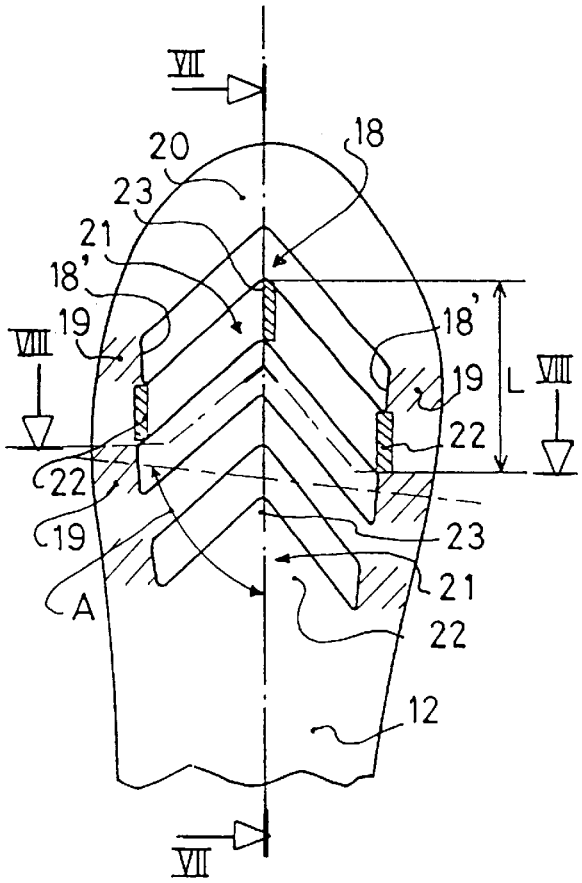
FIGS. 6, 7, 8 and 9 schematically represent the nerve layer of the sole of FIGS. 4 and 5 and its functioning, specifically.
Figure 7:
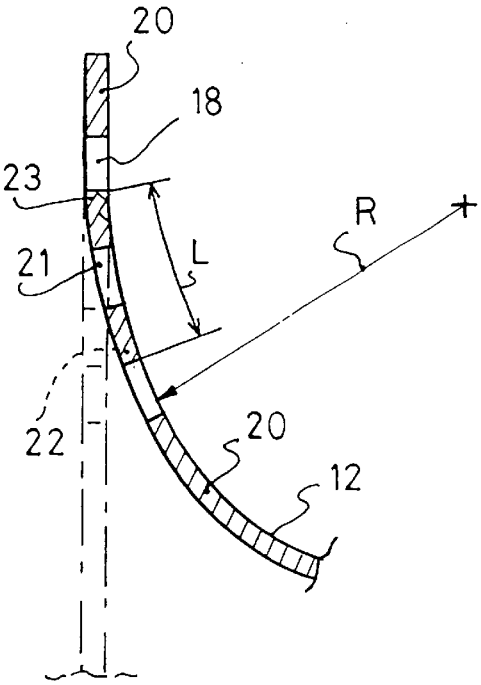
Figure 8:
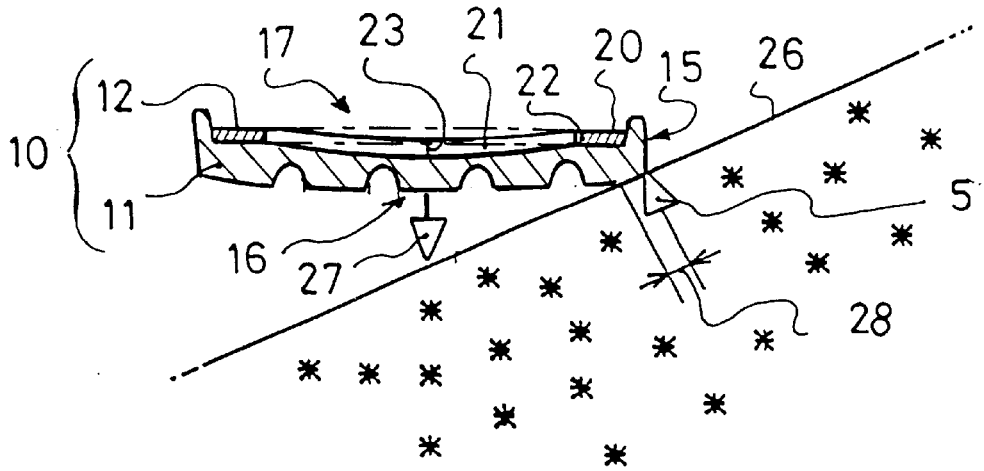

The sole 10 represented in FIG. 4 is constituted of a wear layer 11, a layer known as the nerve layer 12 or reinforcement, i.e., a layer having rigidity characteristics adapted to the practice of the sporting activity in question, and a comfort layer or insole 13, and equips a boot 14, as illustrated in FIG. 5. This sole 10 has a differentiated flexibility between its periphery 15, delineated by the side edge of the wear layer 11 and its central zone 16, due to a flexible structure 17 which is obtained in the nerve layer 12. Specifically, the latter is obtained with a frame 20 within which several transverse recesses 18 are spaced. As shown in the exemplary drawings, these recesses 18 are preferably empty, through holes. According to a constructional detail, each transverse recess 18 extends up the vicinity of the frame 20 so as to leave behind material bridges 19, identified by the fine lines of FIG. 4, and adapted to partially constitute the frame 20.

According to an essential characteristic of a preferred embodiment of the invention, each recess 18 defines, between its two ends 18', the contour of a strip 21 whose attaching base 22 originates from the nerve layer 12, and whose free end 23 extends within the frame 20, by being approximately centered in the nerve layer 12 longitudinal direction. The term "free end" 23 of the strip 21 refers to a forwardmost or rearwardmost part of the strip with respect to the lateral attaching bases 22. FIG. 4 illustrates exemplary forwardly oriented free ends 23 in the front part of the nerve layer or insert, and rearwardly oriented free ends 23 in the rear part of the nerve layer or insert. Further, as shown in the exemplary drawings, the free ends 23 are "free" at least in the sense that the free ends 23 are not connected, at such free ends, to a longitudinally successive strip 21.

In this first embodiment, which is also illustrated in FIGS. 6, 7, 8 and 9 that follow, the strips 21 have a broken contour similar to that of a "V" which gives the nerve layer 12 a flexible zig-zag structure that extends inside its frame 20. In view of the mutual coming together of the strips 21, a series of mutually independent bands is in fact obtained, each of which comprises two lateral attaching bases 22 basically originating from the frame 20 of the nerve layer 12.

Preferably, the flexible structure 17 of the nerve layer 12 is obtained in those zones of the sole 10 that are made to bend longitudinally, such as the zones 24 and 25 that respectively correspond to the instep and the heel of the user's foot. As such, these zones 24 and 25 are equipped with a greater ability to be deformed in the direction of the course of motion of the foot, which facilitates walking, both by providing dampening for the heel at impact with the ground, as well as for propulsion at the level of the instep.

Especially for the propulsion phase, it is necessary that the sole 10, along with its nerve layer 12, be able to bend along a radius of curvature R, that is more or less accentuated and determined depending on the type of boot in question, for example, whether it is a walking or a running boot.

Consequently, each strip 21 has a certain length L that is defined in accordance with this radius of curvature R so that it is systematically biased to bend between its attaching base 22 and its free end 23, concomitantly with the frame 20 of the nerve layer 12 so as to reinforce the resistance to longitudinal bending of the latter. Indeed, for a given type of boot in which the radius of curvature R is always large, the strip 21 must be relatively long in order to be biased to bend significantly, whereas for a small radius of curvature R, the strip 21 can be short.

Due to these various characteristics, the flexible structure 17 of the nerve layer 12 has a certain potential for transverse and vertical deformation, which is provided by the mobility and flexibility of the free end 23 of each strip 21 with respect to its base 22 and, as a result, with respect to the frame 20 of the nerve layer 12.

Consequently, the sole 10 constituted of at least the wear layer 11 and the nerve layer 12 with its flexible structure 17 is capable of being deformed in its central zone 16 without the frame 20 of the nerve layer 12 being really biased. For instance, in the example of an edge setting on a sloping terrain 26, as illustrated schematically in FIG. 8, the forces that are exerted vertically on the sole 10 and laterally along its periphery 15 which is in contact with the ground can cause the downward curving of the central zone 16 of the sole 10, as indicated by the arrow 27, without subjecting the frame 20 of the nerve layer 12 to strong transverse stresses. Indeed, the downward curvature of the central zone 16 of the sole 10 is almost entirely obtained due only to the mobility-flexibility of the free end 23 of each strip 21 with respect to its attaching base 22 on the frame 20. This ability of the sole 10 to be deformed downwardly allows a significant increase in the contact surface 28 in the sole 10/ground 26 interface, and consequently improves the quality of the lateral support 5 in terms of sureness and stability.

Figure 9:
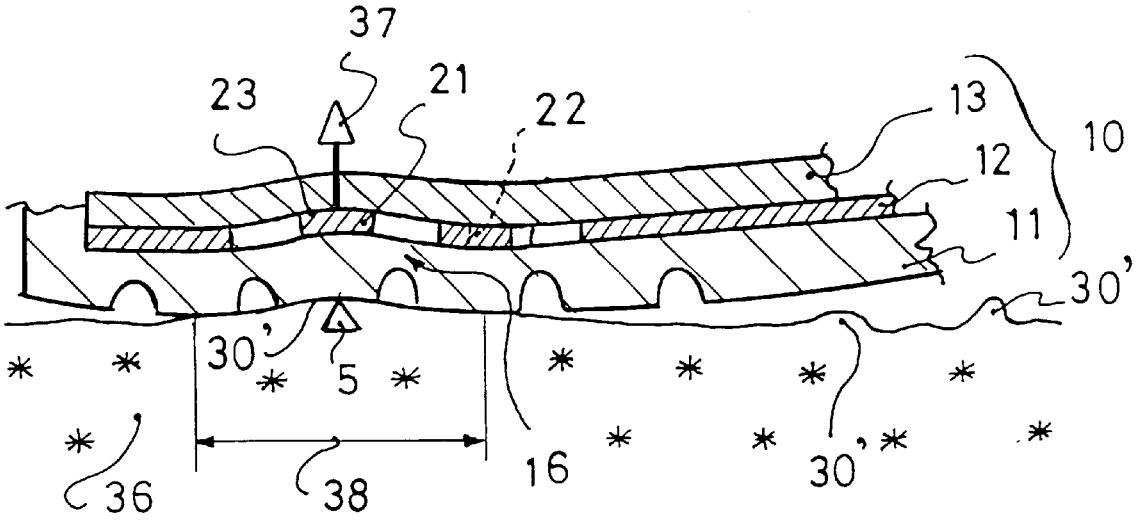

In addition, on a ground 36 having numerous rough spots 30', as illustrated in FIG. 9, the deformation capacity of the sole 10 in its central zone 16 also allows for an increase in the contact surface 38 in the sole 10/ground 36 interface by conforming to some of these rough spots 30' and also allows a better perception of the terrain.

In this case, the sole 10 curves upwardly as indicated by the arrow 37, the wear layer 11 pushing back the flexible strip or strips 21 of the nerve layer 12, that are positioned opposite the rough spot 30' on which the main support 5 is taken. Due to this functioning of the flexible structure 17 of the nerve layer 12 in the sole 10, each strip 21 acts like a shield that attenuates the upwardly directed vertical deformations and filters the shocks by diffusing them over its entire surface, thus preserving the comfort of the foot which is thus protected from very localized pressures, while improving its feel.

The embodiment of the sole 10 described previously shows a nerve layer 12 comprising a flexible structure 17 inside its frame 20 located in correspondence with the zones 24 and 25 of the user's instep and heel. Obviously, in accordance with other non-represented embodiments, the flexible structure 17 could be provided only in correspondence with either one of these zones 24 or 25.

Furthermore, the flexible structure 17 obtained with a plurality of strips 21 having a broken V-shaped contour could be envisioned with a single strip 21, and the ends 18' of the transverse recess 18 delineating it could advantageously be oriented substantially transversely with respect to the median longitudinal axis 29 of the nerve layer 12 (illustrated in FIGS. 4 and 6) along an angle A selected in relation to the angle of the bending axis of the metatarsophalangian joint of the user's foot (not represented). In other words, the sole of the boot comprises a metatarso-phalangian zone extending along a transverse bending axis, corresponding to a metatarso-phalangian joint of a user's foot, positioned at an angle a with respect to the median longitudinal axis of the nerve layer, and the opposed ends 18' of the transverse recess 18 are positioned along a line that is substantially parallel to the transverse bending axis.

Obviously, the strip and/or strips 21 can also be provided to be off-centered with respect to the median longitudinal axis 29 and have a sinuous contour.

Yet again, the strip and/or strips can be obtained in the nerve layer 12 in such a way that their free end 23 points in the direction of the frontal end 24 of the sole 10, or in the direction of the rear end 25 thereof, as desired.

Finally, the strip and/or strips 21 can have contours other than V-shaped contours, for example, W-shaped contours, both in the transverse as well as in the longitudinal directions, and these contours can have broken or sinuous shapes.

The essential point is for the strip and/or strips 21 to reinforce the resistance provided by the frame of the nerve layer in longitudinal bendings and to allow, in the area over which it extends, a certain potential for the transverse and vertical deformation of the sole.

The invention is not limited to soles whose nerve layer defines a continuous frame, and also finds an application in soles whose nerve layer defines a frame that extends at least along a portion of the periphery of said sole.

What is claimed is:

1. A boot comprising a sole made of at least two layered portions, said layered portions comprising a wear layer and a nerve layer, said nerve layer extending in a longitudinal direction between a front and a rear, said nerve layer having a frame defining a periphery of said nerve layer and at least one recess extending substantially transversely to said longitudinal direction, said frame of said nerve layer comprising, at transversely opposed ends of said recess, material bridges, said substantially transverse recess in said nerve layer defining, between said opposed ends, at least one strip, said strip having an attaching base and a free end, said attaching base originating from said nerve layer and said free end extending inside said frame of said nerve layer.

2. A boot according to claim 1, wherein:

said free end of said strip is substantially centered in said nerve layer along said longitudinal direction.

3. A boot according to claim 1, wherein:

said at least one recess comprises a plurality of longitudinally spaced apart transverse recesses; and said at least one strip comprises a plurality of longitudinally spaced apart and independent transverse strips.

4. A boot according to claim 1, wherein:

said sole comprises a longitudinally deformable zone, said sole being made of a deformable material to allow bending longitudinally along a determinate radius of curvature of said sole during a walking motion of a user of the boot; and said strip of said nerve layer is located in a zone of said nerve layer corresponding to said longitudinally deformable zone of said sole.

5. A boot according to claim 4, wherein:

said strip has a length defined longitudinally between at least one of said transversely opposed ends of said recess and said free end of said strip, said length of said strip being defined by said radius of curvature, said radius of curvature being defined by a motion of the user's foot during said waking motion, said strip being systematically biased to bend along said length between said attaching base and said free end concurrently with a bending of said frame of said nerve layer of said sole.

6. A boot according to claim 4, wherein:

said strip comprises transversely opposed ends;

said free end of said strip comprises an extent of said strip longitudinally forward of said transversely opposed ends.

7. A boot according to claim 5, wherein:

said free end of said strip comprises a forwardmost extent of said strip.

8. A boot according to claim 5, wherein:

said strip comprises transversely opposed ends;

said free end of said strip comprises an extent of said strip longitudinally rearward of said transversely opposed ends.

9. A boot according to claim 5, wherein:

said free end of said strip comprises a rearwardmost extent of said strip.

10. A boot according to claim 7, wherein:

said strip has a contour with a broken shape between said opposed ends of said transverse recess.

11. A boot according to claim 9, wherein:

said strip has a contour with a broken shape between said opposed ends of said transverse recess.

12. A boot according to claim 7, wherein:

said strip has a substantially V-shape between said opposed ends of said transverse recess.

13. A boot according to claim 9, wherein:

said strip has a substantially V-shape between said opposed ends of said transverse recess.

14. A boot according to claim 7, wherein:

said strip has a sinuous shape between said opposed ends of said transverse recess.

15. A boot according to claim 9, wherein:

said strip has a sinuous shape between said opposed ends of said transverse recess.

16. A boot according to claim 12, wherein:

said sole comprises a metatarsophalangian zone extending along a transverse bending axis, said transverse bending axis being positioned at an angle with respect to a median longitudinal axis of said nerve layer and corresponding to a metatarso-phalangian joint of a user's foot; and said opposed ends of said transverse recess are positioned along a line substantially parallel to said transverse bending axis.

17. A boot according to claim 1, wherein:

said strip is off-centered transversely with respect to a median longitudinal axis of said nerve layer.

18. A boot according to claim 1, wherein:

said nerve layer extends generally along a plane beneath a user's foot;

said strip has a contour and is made of a material to allow deformation substantially perpendicularly to said plane of said nerve layer independent of said frame of said nerve layer.

19. A boot according to claim 1, wherein:

said nerve layer extends generally along a plane beneath a user's foot;

said free end of said strip has a contour to allow deformation of said free end substantially perpendicularly to said plane of said nerve layer independent of said frame of said nerve layer.

20. A boot comprising:

a sole comprising at least two layers, said two layers comprising a external layer and a nerve layer;

said nerve layer extending in a longitudinal direction between a front and a rear, said nerve layer having a frame defining a periphery of said nerve layer, said nerve layer having at least one recess extending substantially transversely to said longitudinal direction between transversely opposed ends of said recess, said frame of said nerve layer comprising a material bridge at at least one of said transversely opposed ends of said recess;

said substantially transverse recess defining at least one strip, said at least one strip comprising means for reinforcing a resistance provided by said frame of said nerve layer during longitudinal bending of said sole, and for allowing, in an area over which said strip extends, transverse and vertical deformation of said sole substantially independent of any deformation of said frame.

21. A boot according to claim 20, wherein:

said at least one recess comprises a plurality of longitudinally spaced apart transverse recesses; and said at least one strip comprises a plurality of longitudinally spaced apart and independent transverse strips.

22. A boot according to claim 21, wherein:

at least one of said plurality of strips is located in a heel zone of said sole and at least one of said plurality of strips is located in an instep zone of said sole.

23. A boot comprising:

an upper;

a sole affixed to said upper, said sole comprising an external wear layer, an intermediate layer positioned above said external wear layer, and an insole positioned above said intermediate layer;

said intermediate layer comprising:

a peripheral extent constituting a frame for reinforcing at least a periphery of said sole; and an interior having a structural configuration for allowing deformations of said intermediate layer in directions toward both said external sole and said insole, said structural configuration of said interior of said intermediate layer comprising at least two longitudinally spaced apart transversely elongated recesses, each of said two recesses comprising a through hole in said intermediate layer, said two recesses defining a transverse strip;

said transverse strip having transversely opposed ends connecting said strip with said peripheral extent of said intermediate layer, said transverse strip further having a portion longitudinally spaced forwardly or rearwardly from both of said ends.

24. A boot according to claim 23, wherein:

said portion of said strip constitutes a forwardmost extent of said strip.

25. A boot according to claim 23, wherein:

said portion of said strip constitutes a rearwardmost extent of said strip.

26. A boot according to claim 23, wherein:

said portion of said strip is substantially centered longitudinally in said intermediate layer.

27. A boot according to claim 23, wherein:

said structural configuration of said interior of said intermediate layer comprises additional ones of said two longitudinally spaced apart transversely elongated recesses to define a plurality of said transverse strips, each of said transverse strips having respective portions longitudinally spaced forwardly or rearwardly from both of said ends of respective ones of said strips, said plurality of transverse strips being longitudinally spaced apart and each of said plurality of transverse strips being independent of others of said transverse strips.

* * * * *